US008922608B2

(12) United States Patent
Mizutani

(10) Patent No.: US 8,922,608 B2
(45) Date of Patent: Dec. 30, 2014

(54) DECOLORIZING DEVICE AND DECOLORIZATION CONDITION SETTING METHOD

(71) Applicant: Toshiba Tec Kabushiki Kaisha, Tokyo (JP)

(72) Inventor: Kikuo Mizutani, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/839,838

(22) Filed: Mar. 15, 2013

(65) Prior Publication Data

US 2013/0242026 A1 Sep. 19, 2013

Related U.S. Application Data

(60) Provisional application No. 61/612,236, filed on Mar. 16, 2012.

(51) Int. Cl.
*B41M 7/00* (2006.01)

(52) U.S. Cl.
CPC ..... *B41M 7/0009* (2013.01)
USPC ..... 347/179

(58) Field of Classification Search
CPC ..... B41M 7/00; B41M 7/009
USPC ..... 347/171, 179
See application file for complete search history.

(56) References Cited

U.S. PATENT DOCUMENTS

| | | | | |
|---|---|---|---|---|
| 8,284,220 | B2 * | 10/2012 | Takayama et al. | 347/171 |
| 2011/0222130 | A1 | 9/2011 | Iguchi et al. | |
| 2011/0234721 | A1 | 9/2011 | Endo | |
| 2012/0056962 | A1 * | 3/2012 | Takayama et al. | 347/179 |

FOREIGN PATENT DOCUMENTS

| | | |
|---|---|---|
| JP | 05-289575 | 11/1993 |
| JP | 08-305228 | 11/1996 |
| JP | 09-044042 | 2/1997 |
| JP | 2010-276664 | 12/2010 |

* cited by examiner

*Primary Examiner* — Huan Tran
(74) *Attorney, Agent, or Firm* — Patterson & Sheridan LLP

(57) ABSTRACT

A decolorizing device includes a paper feed unit that feeds a sheet, on which an image has been formed using a color-erasable colorant, into a conveying path. A decolorization unit conveys the sheet fed by the paper feed unit into the conveying path while heating the sheet to a prescribed heat source setting temperature to decolorize the image on the sheet. A scanner reads and electronically processes the image and outputs an image density before and after decolorizing. A reject determination part determines the sheet, on which the image remains, as a reject sheet based on the image density after decolorizing. For the sheet determined as a reject sheet by the reject determination unit, when it is determined that the image density after decolorizing is lower than the image density before decolorizing, a decolorization condition setting part controls the heat source setting temperature in the decolorization unit to be higher.

20 Claims, 8 Drawing Sheets

DECOLORIZING DEVICE AND DECOLORIZATION CONDITION SETTING METHOD

CROSS-REFERENCE TO RELATED APPLICATION

This application is based upon and claims the benefit of priority from U.S. Provisional Application No. 61/612,236, filed Mar. 16, 2012; the entire contents of which are incorporated herein by reference.

FIELD

Embodiments described herein relate generally to a decolorizing device and a decolorization condition setting method.

BACKGROUND

Recently, images are formed on sheets by image forming devices such as an MFP (Multi Function Peripheral). In addition, to reutilize a sheet by removing an image formed on a sheet, the image is printed on the sheet with a color-erasable colorant such as ink containing a leuco dye. The color-erasable colorant can be decolorized under high temperature. In a decolorizing device, a platen roller and a heat source are oppositely arranged via a conveying path of sheets. The sheets are heated when they are conveyed between the platen roller and the heat source.

In addition, the decolorizing device has a scanner to scan the images on the paper before decolorizing and to classify the paper condition after decolorizing. In such a decolorizing device, a circulation path is internally installed to achieve scanning of images, decolorization, and classifying process of sheets. The scanner is disposed downstream of a paper feed unit. A circulation path switching point is installed downstream of the scanner. Moreover, a decolorization unit is disposed in the circulation path, and the circulation path is joined in front of the scanner. A sheet is scanned by the scanner, conveyed to the circulation path, and then decolorized. Next, after the decolorization treatment, the sheet is re-conveyed to the scanner, classified, and conveyed to a paper discharge unit.

However, in case the room temperature is low, the temperature of the decolorizing sheet may be low, or the printing density on the sheet may be high. Sufficient decolorization cannot be realized in any of these cases. For this reason, in a classification process of the sheet after decolorizing, even if the sheet could be completely decolorized under appropriate conditions, the sheet is determined as a non-reusable sheet, lowering the reutilization rate of the sheet.

DETAILED DESCRIPTION

In general, a decolorizing device according to one embodiment includes a paper feed unit that feeds a sheet, on which an image has been formed using a color-erasable colorant, into a conveying path. A decolorization unit conveys the sheet fed by the paper feed unit into the conveying path while heating the sheet by heat sources at a prescribed heat source setting temperature and decolorizes the image on the sheet. A scanner reads and electronically processes the image and outputs an image density before and after decolorizing, where "image density" represents the amount of image (per area) that is printed on the entire sheet. A reject determination unit determines the sheet, on which the image remains, as a reject sheet based on the image density after decolorizing. For example, in case the image density of the sheet after the decolorization treatment is higher than a preset threshold image density, the sheet after the decolorization treatment is determined as a reject sheet. For the sheet determined as a reject sheet by the reject determination unit, when it is determined that the image density after decolorizing is lower than the image density before decolorizing, a decolorization condition setting unit controls the heat source setting temperature in the decolorization unit to be higher.

Next, an embodiment for applying the present disclosure will be explained with reference to the drawings. Here, the same symbols are given to the same parts in each drawing.

Figure 1:
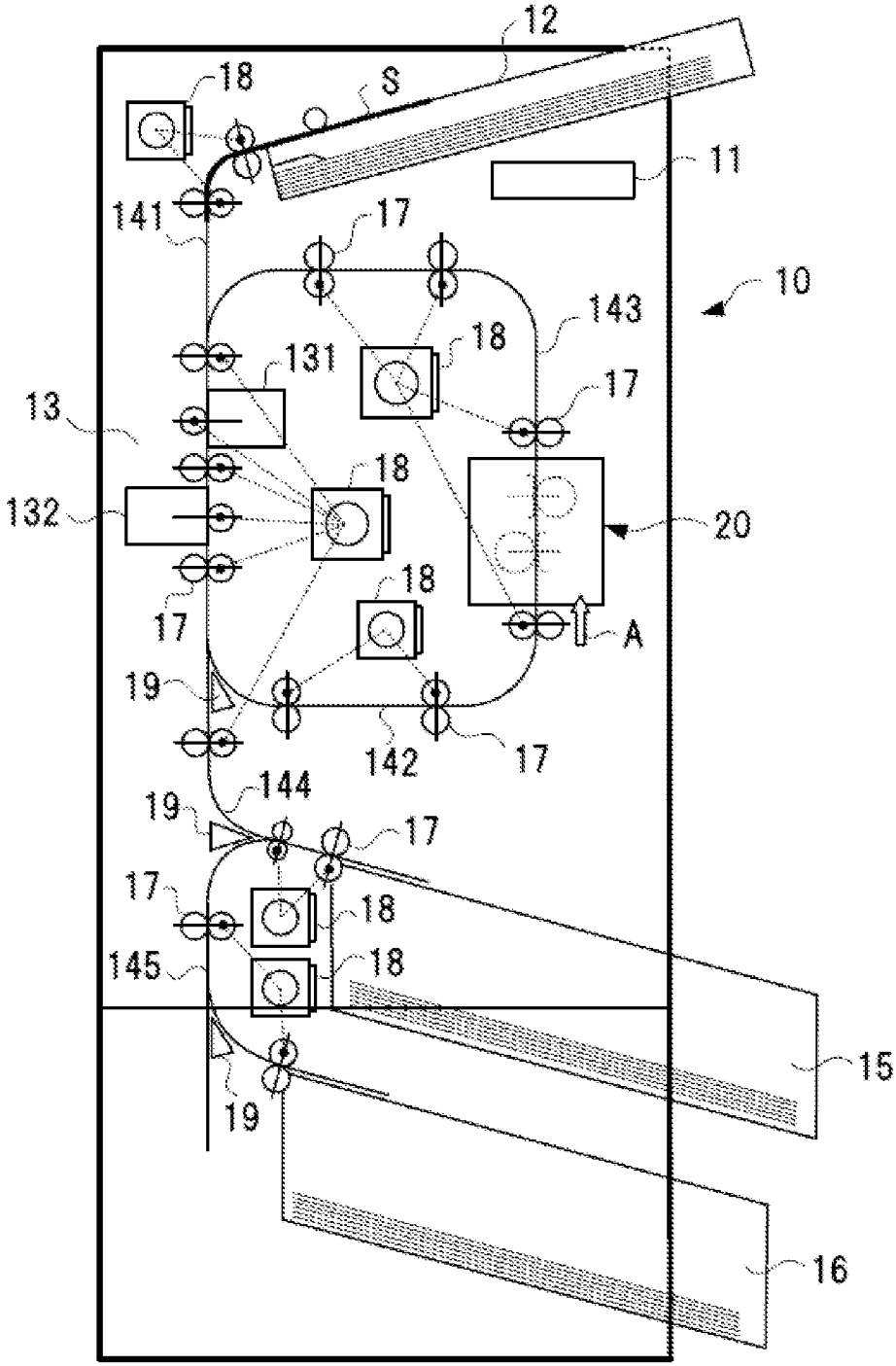
FIG. 1 is a diagram showing the inside of the decolorizing device according to one embodiment.

FIG. 1 is a configuration diagram showing the inside of the decolorizing device of this embodiment. The decolorizing device 10 is provided with a control panel 11 including operation buttons and a display unit, a paper feed unit 12, a scanner 13 as a reading unit, and a decolorization unit 20. In addition, the decolorizing device 10 includes a first conveying path 141, a second conveying path 142, a third conveying path 143, a fourth conveying path 144, a fifth conveying path 145, a first paper discharge tray 15, and a second paper discharge tray 16. The second paper discharge tray 16 may be referred to as a reject tray.

Each conveying path 141-145 has several transport rollers 17 for transporting sheets S and several motors 18 for driving several transport rollers 17. In addition, several gates 19 are installed in each conveying path 141-145 to precisely convey the sheets S to the appropriate conveying path 141-145.

The first conveying path 141 conveys the sheets S to the scanner 13 from the paper feed unit 12. The second conveying path 142 conveys the sheets S from the scanner 13 to the decolorization unit 20 in the direction shown by the arrow A. The third conveying path 143 re-conveys the sheets S from the decolorization unit 20 to the scanner 13. The fourth conveying path 144 conveys the sheets S from the scanner 13 to the first paper discharge tray 15. The fifth conveying path 145 conveys the sheets S from the scanner 13 to the reject box 16.

The first paper discharge tray 15, for example, recovers reusable sheets S after a decolorization treatment of images. The sheets S that are sent to the reject box 16 cannot be reutilized and are usually destroyed or recycled.

Figure 2:
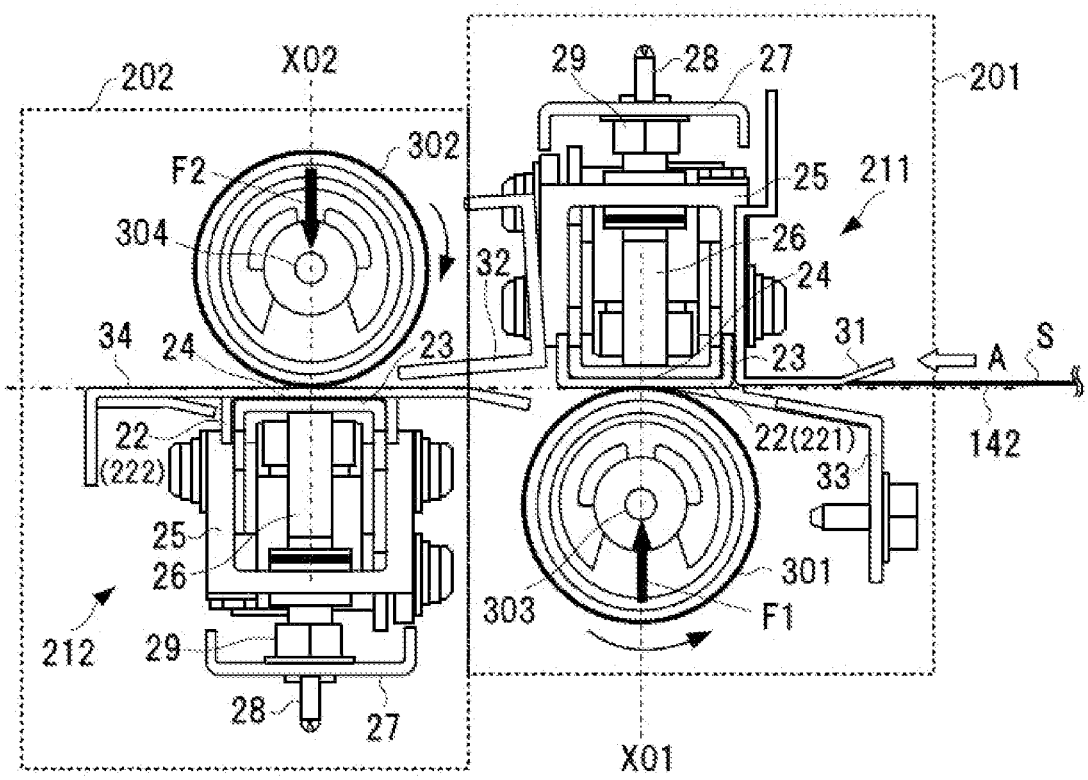
FIG. 2 is a side view showing the structure of a decolorization unit shown in FIG. 1.

Next, a detailed configuration of the decolorization unit 20 will be explained. FIG. 2 is a side view showing an embodiment of the decolorization unit 20.

As shown in FIG. 2, the decolorization unit 20 has a first decolorization unit 201 and a second decolorization unit 202. The first decolorization unit 201 includes a heating unit 211 and a platen roller 301, and the second decolorization unit 202 includes a heating unit 212 and a platen roller 302. In addition, the first decolorizing unit 201 and the second decolorizing unit 202 have the same configuration, except that the top and bottom are inverted. The platen roller 301 and the platen roller 302 are rotary rollers that rotate round rotational shafts 303 and 304, respectively, and have a cylindrical shape extending in the axial direction of the sheets S.

Next, the heating unit 211 of the first decolorization unit 201 will be explained. The sheets S are conveyed onto the second conveying path 142 from the arrow A direction. The arrow A direction of FIG. 2 corresponds to the direction of the arrow A of FIG. 1. The heating unit 211 has a heating plate 22 with a U-shaped cross section and a flat surface in contact with the sheets S, a press member 23, and a planar heater 24 between the heating plate 22 and the press member 23. The heating plate 22, press member 23, and heater 24 constitute a heating member.

The heater 24, for example, is a face-shaped heater composed of a metal foil (SUS304) sandwiched between polyimides (PI) as insulating materials. The heater 24 has structural characteristics of excellent thinness and flexibility, is composed of a thin material, and has a very high temperature rate of increase when it is heated. The heating plate 22 is formed of a material with excellent heat conduction, for example, aluminum alloy (A5052P-H34). Here, a heat source of the first decolorization unit 201 at an upstream of the conveying path may include one unit, i.e., a main heat source lamp. On the other hand, a heat source of the second decolorization unit 202 at a downstream of the conveying path may include two units, i.e., a main heat source lamp and a heat source sub-lamp, that individually may have a heat capacity smaller than that of the heat source lamp of the first decolorization unit 201. Similarly, both the upstream and the downstream may include two or three or more units of heat source lamps to control heating. Here, as the heating unit 211, a cylindrical heating roller may be adopted instead of the face-shaped heater.

The press member 23 is covered with a cover 25. A spring 26 for pressurization is installed in the cover 25. A support member 27 is disposed in the upper part of the cover 25. The support member 27 supports the heater 24 so that the heater 24 is parallel with the conveying path of the sheets S. The heating member, including the heater 24, is pressed in the direction of the conveying path 142 via the spring 26. The spring 26 is mounted at the periphery of a shaft 28. The shaft 28 penetrates through the cover 25 and the support member 27. The shaft 28 is fixed to the support member 27 by a bolt/nut 29. Here, the support member 27 is fixed to the decolorizing device 10.

In addition, a guide plate 31 is mounted on the side surface at a sheet entrance side of the cover 25. A guide plate 32 is mounted on the side surface at a sheet exit side of the cover 25. The guide plate 31 guides conveyance of the sheets S into the heating unit 202 along with a guide plate 33. The guide plate 33 is fixed into the decolorizing device 10 opposite to the guide plate 31. Moreover, the guide plate 32 guides conveyance of the sheets S along with a guide plate 34. The guide plate 34 is fixed to the decolorizing device 10 opposite to the guide plate 32. Furthermore, the guide plates 32 and 34 become guides when the sheets S are carried in the second decolorization unit 202. The platen rollers 301 and 302 are, for example, rollers in which a PFA tube is wound on the surface.

Here, the same symbol as that of the heating unit 211 is given to the heating unit 212 of the second decolorization unit 202, and the explanation of its detailed configuration is omitted. The heating plate 22 of the heating unit 211 is explained as the heating plate 221, and the heating plate 22 of the heating unit 212 is explained as the heating plate 222.

Figure 3:
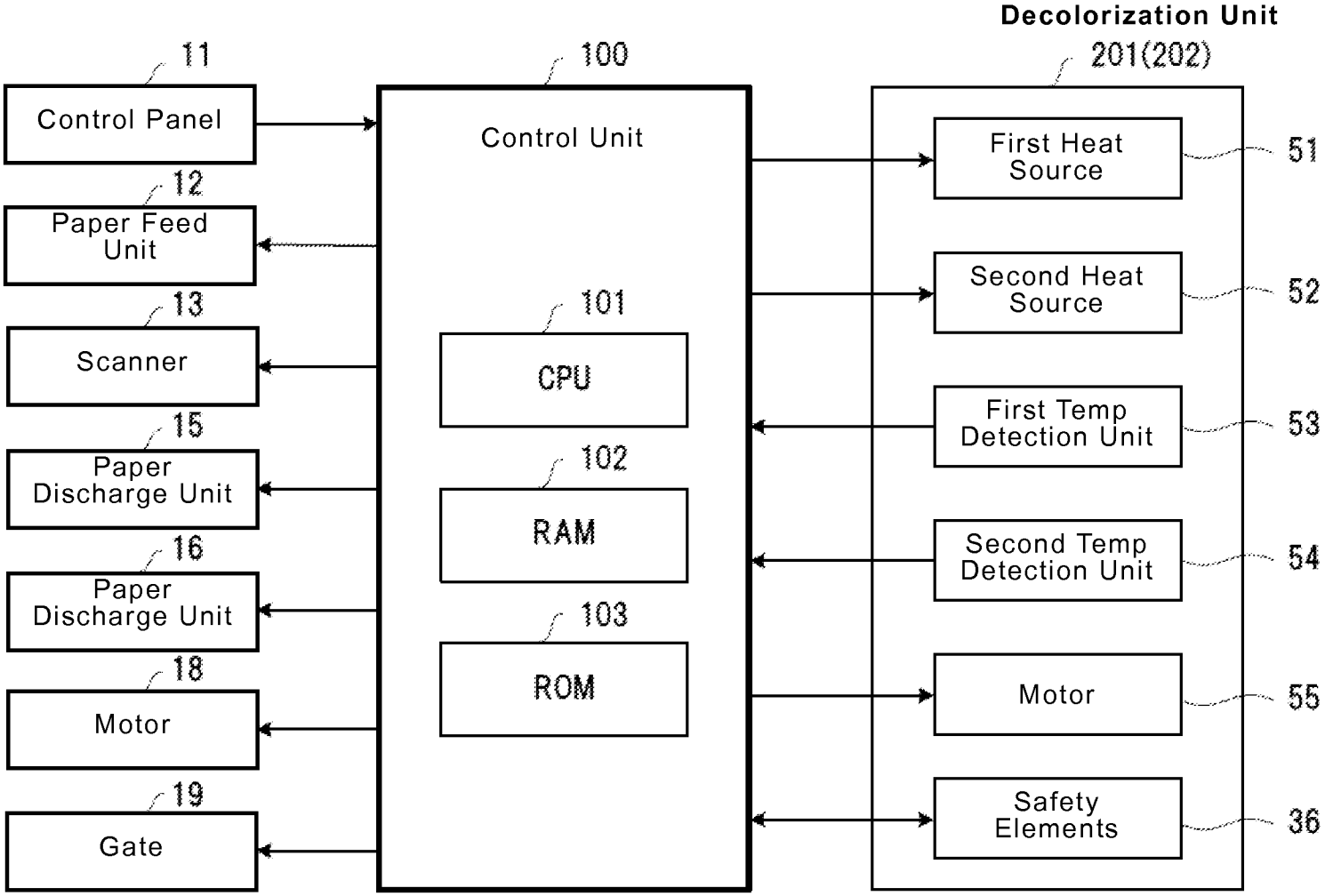
FIG. 3 is a block diagram showing a control system of the decolorizing device shown in FIG. 1.

FIG. 3 is a block diagram showing a control system of the decolorizing device 10 shown in FIG. 1. The decolorizing device 10 is provided with a control unit 100. The control unit 100 includes a processor 101 such as a CPU, a random access memory (RAM) 102, and a read-only memory (ROM) 103.

The processor 101 implements control programs that are stored in the ROM 103. The RAM 102 is a main memory functioning as a working memory. The ROM 103 stores control programs and control data in charge of the operation of the decolorizing device 10.

The control unit 100 controls the paper feed unit 12, scanner 13, paper discharge units 15 and 16, motor 18, and gate 19, based on the instruction from the control panel 11. The control panel 11, for example, is provided with a decolorization start button to instruct decolorization. The paper feed unit 12 feeds sheets, on which images have been formed, one sheet at a time into the conveying path of the decolorizing device 10. The scanner 13 reads and saves the images of the sheets fed. In addition, the scanner 13 attains the print reuse rate of the sheets before and after a decolorization treatment and outputs the image density to the control unit 100.

The control unit 100 controls the motor 18 to drive the transport rollers 17 of each of the first to fifth conveying paths 141-145 and controls the conveyance of the sheets. The control unit 100 also controls the gates 19 to convey the sheets to a selected conveying path. Under the control of the control unit, decolorized sheets are then discharged to the paper discharge unit 15, and non-decolorized sheets or sheets in which tears or wrinkles have been generated are discharged to the paper discharge unit 16.

In addition, the control unit 100 controls on/off of a first heat source 51 and a second heat source 52. The control unit 100 controls the temperature of the first heat source 51 and the second heat source 52 in response to the temperature detection result from a first temperature detection unit 53 and a second temperature detection unit 54. The control unit 100 also controls a transport motor 55 for rotating and driving the platen rollers 301 and 302.

The first heat source 51 corresponds to the heater 24 of the first decolorization unit 201 (or heat source 241 of a heating roller 213). The second heat source 52 corresponds to the heater 24 of the second decolorization unit 202 (or heat source 242 of a heating roller 214).

The first temperature detection unit 53 and the second temperature detection unit 54 correspond to thermistors (not shown in the drawing) of the first decolorization unit 201 and the second decolorization unit 202, respectively. When any of safety elements 36 of the first decolorization unit 201 and the second decolorization unit 202 detects abnormal overheating of the heater 24, the control unit 100 stops the electrification to the heater 24, ensuring safety.

Figure 4:
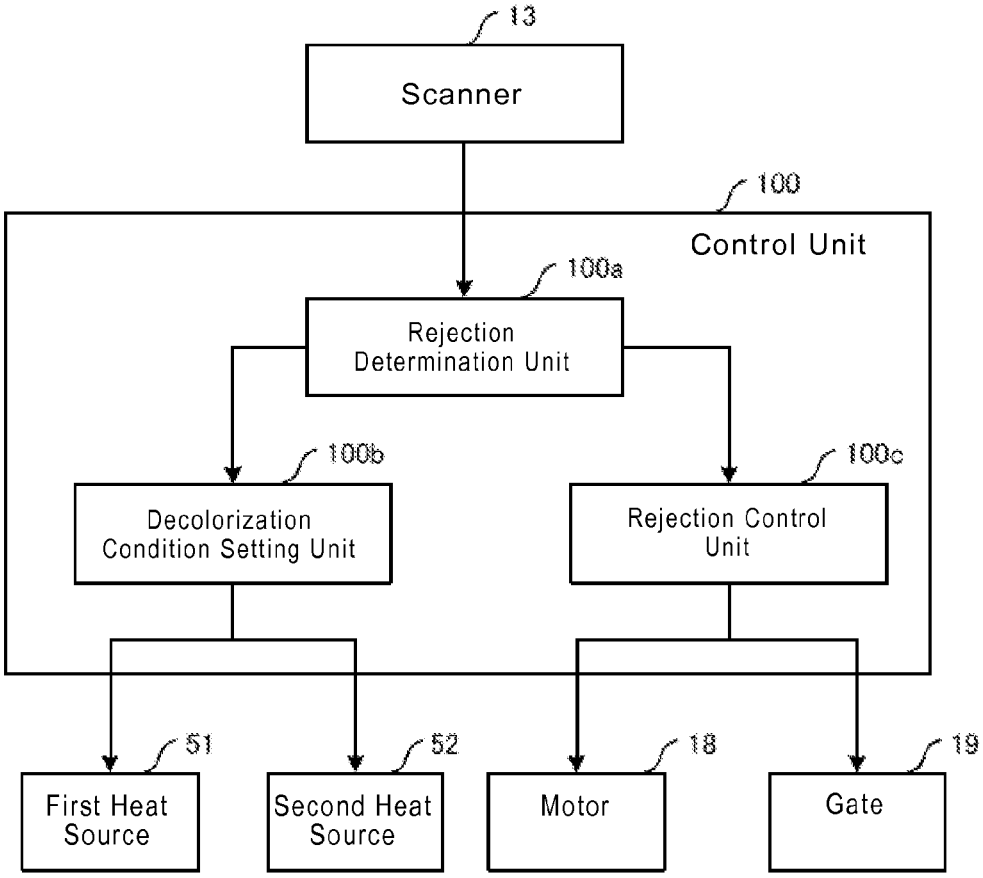
FIG. 4 is a block diagram showing functions for a decolorization condition setup of a control unit shown in FIG. 3.

FIG. 4 is a block diagram showing functions for an decolorization condition setup of the control unit 100 shown in FIG. 3. A reject determination unit 101*a* is a control program that determines whether a sheet, on which an image remains, is a reject sheet based on the image density or sheet condition after the sheet is scanned by the scanner 13. An decolorization condition setting unit 101*b* is a control program that raises the heat source setting temperature in the decolorization unit 20 by a prescribed temperature if the reject determination unit 101*a* has determined that the image density of the sheet after decolorizing is lower than the image density before decolorizing. The heat source setting temperature is called a setting temperature of the first heat source 51 and the second heat source 52 in a decolorization treatment. To reliably decolorize an image on a sheet, the heat source setting temperature is set so that it is relatively higher than the lowest temperature at which a colorant for forming the image is decolorized.

A reject control unit 100*c* is a control program that conveys a sheet to the second paper discharge unit 16 by controlling driving of the motor 18 and opening and closing of the gate 19, when the reject determination unit 101*a* determines that the sheet is a reject sheet.

Here, as mentioned above, the decolorization unit 20 has the first decolorization unit 201 and the second decolorization unit 202. For this reason, to realize efficient decolorization, it is preferable for the decolorization condition setting unit 100*b* to individually control the heat source setting temperature in the first heat source 51 and the second heat source 52. Specifically, the decolorization condition setting unit 100*b* sets the temperature for heating a sheet by the second heat source 52 so that it is lower than the temperature for heating the sheet by the first heat source 51. The reason for this is that when the sheet passed through the first decolorization unit 201 arrives at the downstream side second decolorization unit 202, the sheet still has heat and is in a preheated state, although the temperature is slightly lowered. Therefore, even if the power consumption of the second heat source 52 (heater 24) is cut down in the second decolorization unit 202, the sheet can be heated at a temperature required for decolorization. Thus decolorization with good efficiency can be achieved.

Figure 5:
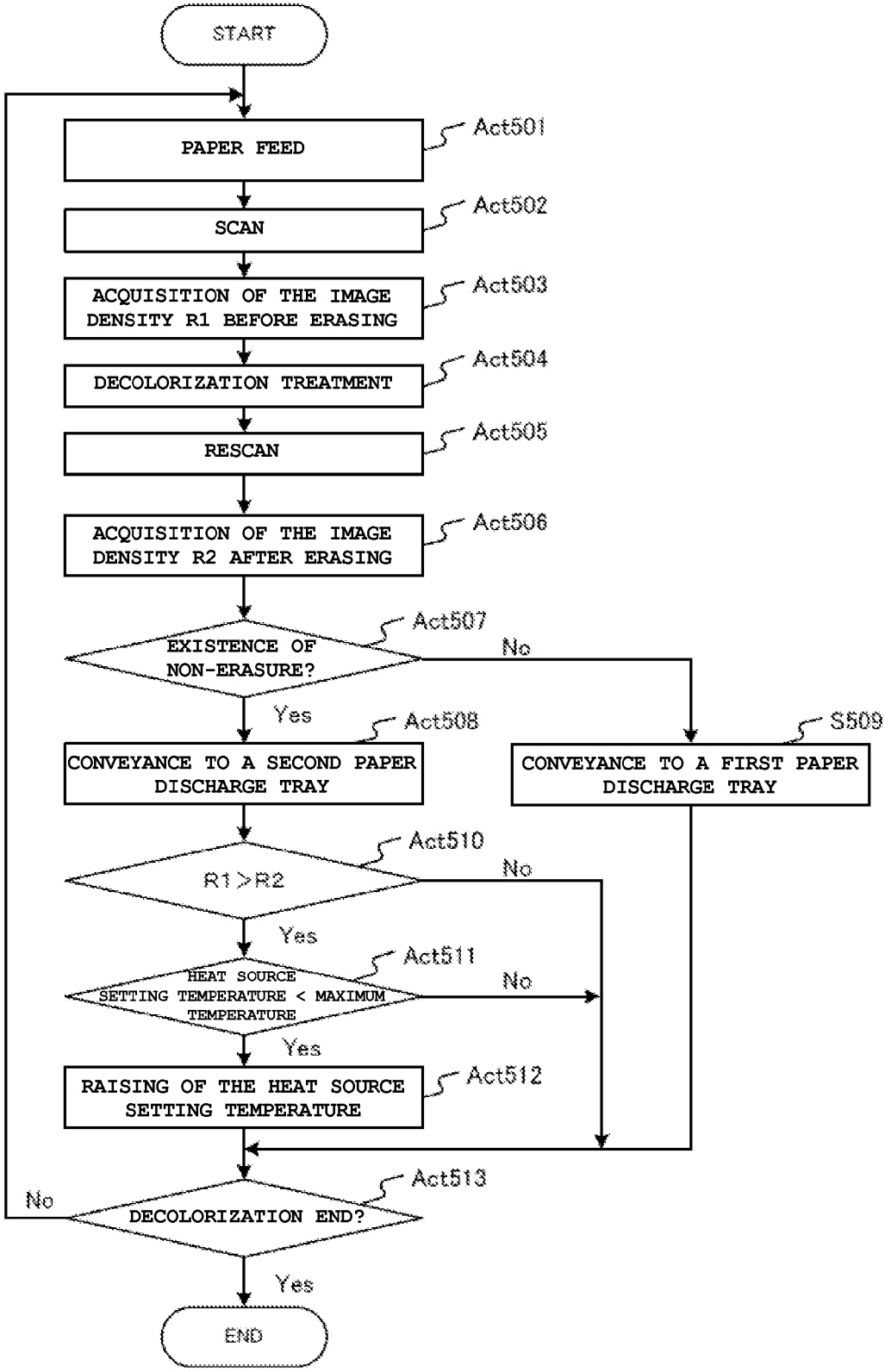
FIG. 5 is a flowchart showing an example of a heat source setting temperature control process in the decolorizing device shown in FIG. 1.

FIG. 5 is a flowchart showing an example of a heat source setting temperature control process in the decolorizing device shown in FIG. 1.

First, when a sheet is fed into the first conveying path 141 from the paper feed unit 12 (Act 501), the scanner 13 scans the sheet that is fed from the paper feed unit 12 (Act 502). The scanner 13 includes a first scanner 131 and a second scanner 132 and scans images of both surfaces before implementing an decolorization treatment. Image data scanned by the scanner 13 is stored in a large-capacity storage device (not shown in the drawing) such as an HDD as a backup.

Next, the control unit 100 (reject determination unit 100*a*) obtains the image density R1 of the image scanned by the scanner 13 and temporarily stores it in a storage area (RAM 102) (Act 503). The control unit 100 (reject control unit 100*c*) guides sheets having tears or wrinkles to the fifth conveying path 145, which conveys the sheets to the second paper discharge unit (reject box) 16, which is not explained herein.

If the sheet is not rejected for tears or wrinkles, the control unit 100 conveys the sheet into the decolorization unit 20, which decolorizes the image formed on the sheet by heating (Act 504). The decolorization unit 20, for example, heats and pressurizes the sheet at a relatively high temperature of 180-200° C. to decolorize the image formed on the sheet with a color-erasable colorant.

Next, the sheet passed through the decolorization unit 20 is conveyed to the scanner 13 through the third conveying path 143 and rescanned (Act 505).

Next, the control unit 100 (reject determination unit 100*a*) obtains the image density R2 of the image read by the scanner 13 after the decolorization treatment of the decolorization unit 20 and temporarily stores it in a storage area (RAM 102) (Act 506). In other words, the scanner 13 confirms whether or not the image formed by the color-erasable colorant in the image area is reliably decolorized.

Next based on the image density R2 after decolorizing output from the scanner 13, the control unit 100 (reject determination unit 100*a*) determines whether or not a non-erased image exists on the sheet (Act 507).

Here, if it is determined that there is a non-erased image on the sheet based on the image density R2 after decolorizing output from the scanner 13 (Act 507: Yes), the control unit 100 (reject determination unit 100*a*) guides the sheet to the fifth conveying path 145 and conveys the sheet to the second paper discharge tray 16 (Act 508), and the flow proceeds to Act 510. In other words, the sheet is handled as an unusable sheet.

On the other hand, it is determined that if there is no non-erased image (Act 507: No), the control unit 100 (reject control unit 100*c*) guides the sheet to the fourth conveying path 144 and conveys the sheet to the first discharge tray 15 (Act 509), and the flow proceeds to Act 513.

At Act 510, the control unit 100 (reject determination unit 100*a*) determines whether or not the image density R2 after decolorizing is lower than the image density R1 before decolorizing. Here, if it is determined that the image density R2 is lower than the image density R1 (Act 510: Yes), the flow proceeds to Act 511. For example, this result occurs in the case where the room temperature is low, the temperature of the sheet to be decolorized is low, the image density of the sheet before the decolorization treatment is high, or the printing density is high. On the other hand, if it is determined that the image density R2 is the same as the image density R1 (Act 510: No), the flow proceeds to Act 513. For example, this result occurs in a sheet on which an image is formed of a colorant whose color is not erasable.

At Act 511, the control unit 100 (decolorization condition setting unit 100*b*) determines whether or not the current heat source setting temperature is lower than the maximum temperature of the heat sources. Here, if it is determined that the current heat source setting temperature is lower than the maximum temperature of the heat sources (Act 511: Yes), the heat source setting temperature of the heat sources (the first heat source 51 and the second heat source 52) of the decolorization unit 20 is raised by a prescribed temperature, for example, 10-20° C. (Act 512), and the flow proceeds to Act 513. On the other hand, if it is determined that the current heat source setting temperature is the maximum temperature of the heat sources (Act 511: No), the flow proceeds to Act 513 without changing the heat source setting temperature.

At Act 513, based on the existence of the sheet to be decolorized, the control unit 100 determines whether or not the decolorization treatment has been finished. Here, if it is determined that the decolorization treatment has been finished (S513: Yes), the processing is finished. On the other hand, if it is determined that the decolorization treatment is not finished (S513: No), the flow returns to Act 501. The processes of Act 501-Act 513 are repeated until there is no more sheet to be decolorized.

Therefore, according to the decolorizing device 10 of this embodiment, even in the case in which sufficient decolorization has not been realized up to now—for example, the case where the room temperature is low, the temperature of a sheet to be decolorized is low, or the printing density is high—the decolorization can be reliably carried out. As a result, the reuse rate of the sheet can be increased.

Figure 6:
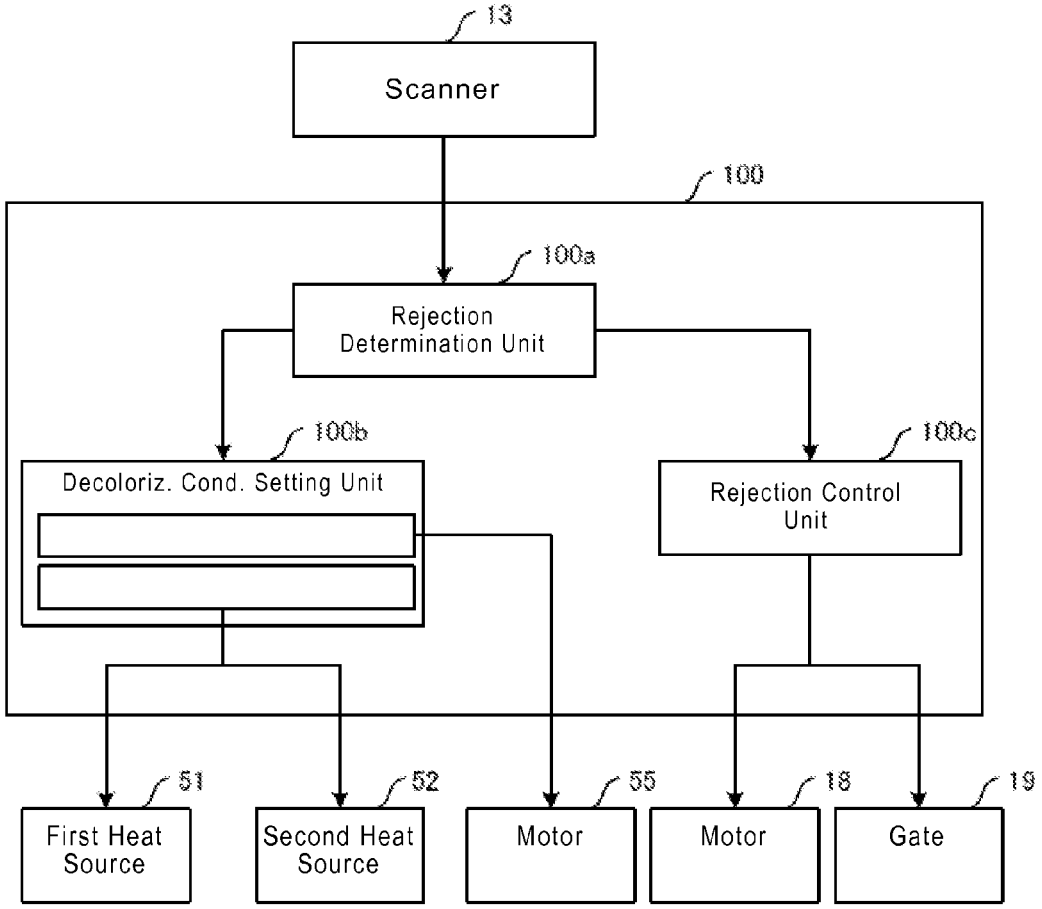
FIG. 6 is a block diagram showing functions for a decolorization condition setup of the control unit according to an alternate embodiment.

Here, in the embodiment, the heat source setting temperature is set to a temperature higher than that of the previous decolorization treatment to prevent non-erasure in sheets that are fed through the decolorization unit 20 again. However, control of the decolorization unit 20 is not limited to this configuration. FIG. 6 shows that the decolorization condition setting unit 100*b* controls driving of the transport motor 55 in the decolorization unit 20 based on the determination result in the reject determination unit 100*a*.

Figure 7:
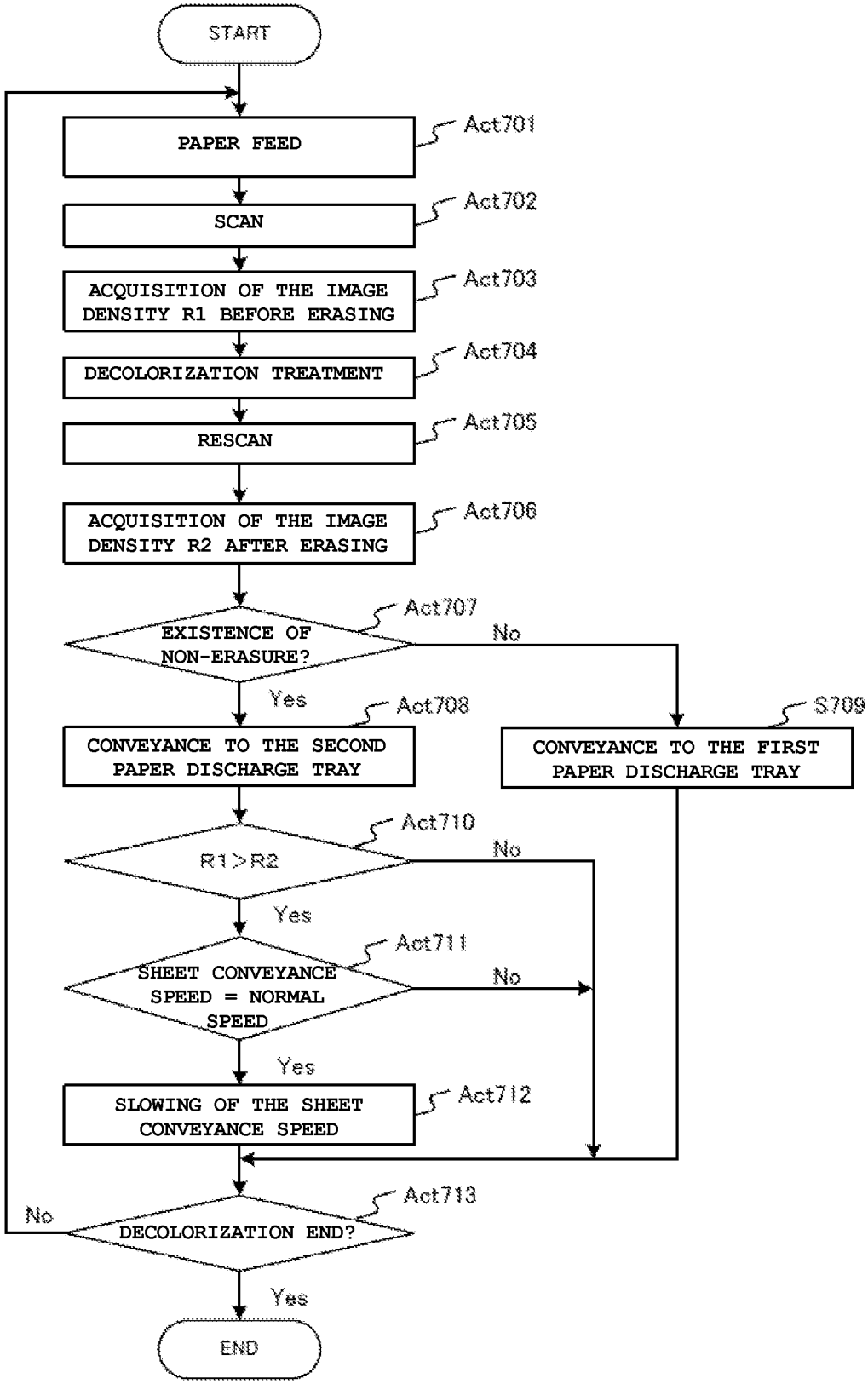
FIG. 7 is a flow chart showing an example of a sheet transfer speed control process in the decolorizing device shown in FIG. 6.

FIG. 7 is a flow chart showing a detailed example of a sheet transfer speed control process in the decolorizing device shown in FIG. 6. In the flow chart shown in FIG. 7, only Acts 711 and 712 are different from that of corresponding Acts 511 and 512 in FIG. 5. Since Act 701-710 and Act 713 of FIG. 7 are common to Act 501-510 and Act 513 of FIG. 5, their explanation is omitted.

At Act 711, the control unit 100 (decolorization condition setting unit 100*b*) determines whether or not the current sheet conveyance speed is a normal speed. Here, if the current sheet conveyance speed is determined as a normal speed (Act 711: Yes), the flow proceeds to Act 712. On the other hand, if it is determined that the current sheet conveyance speed is not a normal speed, that is, in a low speed mode slower than a normal speed (Act 711: No), the flow proceeds to Act 713 without changing the sheet conveyance speed.

At Act 712, for the sheet determined as a reject sheet by the reject determination unit 100*a*, if it is determined that the image density R2 after decolorizing is lower than the image density R1 before decolorizing, the control unit 100 (decolorization condition setting unit 100*b*) controls the rotation speed of the transport motor 55 in the decolorization unit 20 so that the sheet conveyance speed in the decolorization treatment of the decolorization unit 20 may be slower than a normal speed and can be reduced by about 20%, for instance. Next, the flow proceeds to Act 713.

In this modified example, even if the temperature of the heat sources is constant, the total amount of heat, which is applied into sheets in the decolorization unit 20 can be increased by increasing the conveyance time of the sheet through the decolorization unit 20. The sheet conveyance speed may be controlled alone or in combination with the control of the heat source setting temperature.

Figure 8:
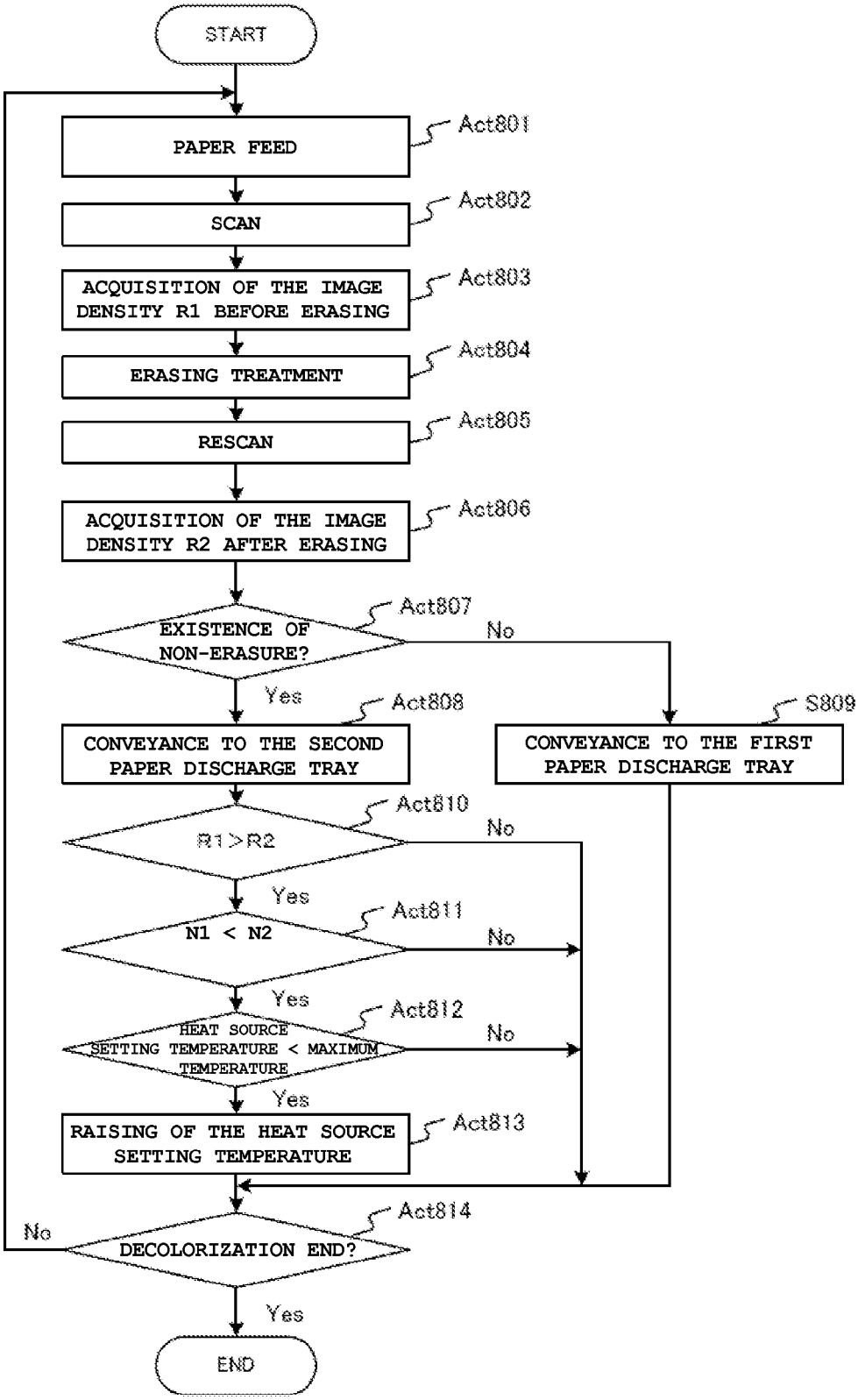
FIG. 8 is a flowchart showing an example of a heat source setting temperature control process in a modified example of the decolorizing device shown in FIG. 1.

FIG. 8 is a flow chart showing a detailed example of a heat source setting temperature control process in a modified example of the decolorizing device shown in FIG. 1. Since Acts 801-810 of FIG. 8 are similar to Acts 501-510 of FIG. 5, their explanation is omitted.

At Act 811, the reject determination unit 100*a* of the control unit 100 determines whether or not the number of continuous times N1 that a sheet has been determined to have the image density R1 after decolorizing that is lower than the image density R1 before decolorizing is less than a predetermined number N2. That is, the reject determination unit compares the number of continuous times N1 a sheet has been passed through the decolorization unit 20 for further decolorizing to the predetermined number N2. Here, if it is determined that the number of times N1 is less than the predetermined number N2 (Act 811: Yes), the flow proceeds to Act 812. On the other hand, if it is determined that the number of continuous times N1 a sheet has been passed through the decolorization unit 20 for further decolorizing is not less than the predetermined number N2 (Act 811: No), the flow proceeds to Act 814.

At Act 812, the decolorization condition setting unit 100*b* of the control unit 100 determines whether or not the current heat source setting temperature is lower than the maximum temperature of the heat sources. If is determined that the current heat source setting temperature is lower than the maximum temperature of the heat sources (Act 812: Yes), the heat source setting temperature of the heat sources (the first heat source 51 and the second heat source 52) of the decolorization unit 20 is raised by a prescribed temperature, for example, 10-20° C. (Act 813), and the flow proceeds to Act 814. On the other hand, if it is determined that the current heat source setting temperature is the maximum temperature of the heat sources (Act 812: No), the flow proceeds to Act 814 without changing the heat source setting temperature.

At Act 814, the control unit 100 determines whether or not the decolorization treatment has been finished based on the existence of the sheet to be decolorized. Here, if it is determined that the decolorization treatment has been finished (Act 814: Yes), the processing is finished. On the other hand, if it is determined that the decolorization treatment is not finished (Act 814): No), the flow returns to Act 801. The processes of Act 801-Act 814 are repeated until there is no more sheet to be decolorized.

Therefore, for the sheets in which the image density R2 after decolorizing is lower than the image density R1 before decolorizing, the decolorization condition setting unit 100*b* may control the heat source setting temperature so that the temperature is higher than the temperature when the decolorizing is implemented if a number of continuous times N1 a sheet has been passed through the decolorization unit 20 for further decolorizing is less than the predetermined number N2. By considering various states of the sheet as the target for decolorizing and the number of sheets for which decolorizing is repeated, and adjusting control of the decolorization unit 20 accordingly, power consumption can be reduced.

In addition, the decolorization condition setting unit 100*b* may control the heat source setting temperature so that the temperature is gradually raised at a prescribed temperature rate. There is an advantage that the power consumption can be suppressed by gradually raising the temperature. Similarly, the sheet conveyance speed may be controlled so that it is gradually slowed from a normal speed.

Moreover, in the embodiment, a single decolorizing device has been explained; however, the decolorizing device of this embodiment may be integrated with an image forming device by assembling it into the image forming device.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A decolorizing device, comprising:

a paper feed unit configured to feed a sheet on which an image has been formed using a color-erasable colorant;

a decolorizing unit configured to heat the sheet at a first heating temperature in order to decolorize the image on the sheet;

a scanner configured to scan a surface of the sheet on which the image was formed and to output an image density of the image before decolorizing and after decolorizing;

a reject determination unit configured to determine that the sheet is rejected based on the image density of the image after decolorizing; and a decolorization condition setting unit configured to control the decolorization unit to heat the sheet that is determined to be rejected at a second heating temperature that is higher than the first heating temperature when it is determined that the image density after decolorizing is lower than the image density before decolorizing.

2. The decolorizing device according to claim 1, wherein the decolorization condition setting unit is configured to control, for the sheet that is determined to be rejected, a conveyance speed through the decolorizing unit so that the conveyance speed is slower than a normal speed when it is determined that the image density after decolorizing is lower than the image density before decolorizing.

3. The decolorizing device according to claim 1, wherein the decolorization condition setting unit is configured to control a change from the first heating temperature to the second heating temperature at a prescribed temperature rate.

4. The decolorizing device according to claim 1, wherein:

when the reject determination unit has determined that a predetermined continuous number of sheets are to be rejected, the decolorization condition setting unit is configured to control the decolorizing unit at a third heating temperature that is higher than the first heating temperature.

5. The decolorizing device according to claim 4, wherein the decolorization condition setting unit is configured to not change a current heating temperature of the decolorizing unit if the current heating temperature is at a predetermined maximum.

6. The decolorizing device according to claim 1, wherein the decolorizing unit includes:

a first decolorizing unit including a first heat source configured to contact a first surface of the sheet at an upstream position on the conveying path, and a first rotary roller disposed opposite to the first heat source, wherein the sheet is pressed between the first heat source and the first rotary roller by rotation of the first rotary roller and the sheet is conveyed while being heated by the first heat source; and a second decolorizing unit including a second heat source configured to contact a second surface of the sheet at a position on the conveying path downstream from the first erasing unit, and a second rotary roller disposed opposite to the second heat source, wherein the sheet is pressed between the second heat source and the second rotary roller by rotation of the second rotary roller and the sheet is conveyed while being heated by the second heat source, and wherein the decolorization condition setting unit is configured to individually control a temperature of the first heat source and a temperature of the second heat source.

7. The decolorizing device according to claim 6, wherein:

the decolorization condition setting unit is configured to control the temperature of the second heat source to be lower than the temperature of the first heat source, and the color-erasable colorant is a color-erasable toner.

8. The decolorizing device according to claim 1, wherein the reject determination unit is configured to accept the sheet if the image density after decolorizing indicates that the image is reliably decolorized.

9. The decolorizing device according to claim 8, further comprising a control unit configured to convey the accepted sheet to a reuse tray.

10. A method for controlling a decolorizing device in which a sheet on which a decolorizable image has been formed is fed into a decolorizing unit, the method comprising:

scanning the image by a scanner and outputting a first image density of the image based on the scanned image;

after the scanning, heating the sheet in the decolorizing unit that includes a heat source at a prescribed heating temperature in order to decolorize the image on the sheet;

after the heating, scanning the image by the scanner and outputting a second image density of the image;

determining whether the sheet is rejected based on the second image density; and for the sheet determined as rejected, if the second image density is lower than the first image density, controlling the erasing unit to heat the heat source at an increased temperature.

11. The method of claim 10, wherein for the sheet determined as rejected, if the second image density is lower than the first image density, a conveyance speed through the decolorizing unit is controlled so that the conveyance speed is slower than a normal speed.

12. The method of claim 10, wherein for the sheet determined as rejected, if the second image density is lower than the first image density, the temperature of the heat source is gradually raised at a prescribed temperature rate.

13. The method of claim 10, wherein:

if a predetermined continuous number of sheets are determined to be rejected, the temperature of the heat source is controlled at a temperature higher than an initial set temperature, and the color-erasable colorant is a color-erasable toner.

14. A decolorizing device, comprising:

a paper feed unit configured to feed a sheet on which an image has been formed using a color-erasable colorant;

a decolorizing unit configured to heat the sheet and convey the sheet at a first conveying speed in order to decolorize the image on the sheet;

a scanner configured to scan a surface of the sheet on which the image was formed and to output an image density of the image before decolorizing and after decolorizing;

a reject determination unit configured to determine that the sheet is rejected based on the image density of the image after decolorizing; and a decolorization condition setting unit configured to control, for the sheet that is determined to be rejected, a conveyance speed through the decolorizing unit so that the conveyance speed is slower than a normal speed when it is determined that the image density after decolorizing is lower than the image density before decolorizing.

15. The decolorizing device according to claim 14, wherein the decolorization condition setting unit is configured to control the decolorizing unit to heat the sheet that is determined to be rejected at a second heating temperature that is higher than the first heating temperature when it is determined that the image density after decolorizing is lower than the image density before decolorizing.

16. The decolorizing device according to claim 15, wherein the decolorization condition setting unit is configured to gradually raise the heat source setting temperature at a prescribed temperature rate.

17. The decolorizing device according to claim 14, wherein:

when the reject determination unit has determined that a predetermined continuous number of sheets are to be rejected, the decolorization condition setting unit is configured to control a temperature of a heat source in the decolorizing unit at a temperature higher than an initial set temperature.

18. The decolorizing device according to claim 17, wherein the decolorization condition setting unit is configured to not change a current heating temperature of the decolorizing unit if the current heating temperature is at a predetermined maximum.

19. The decolorizing device according to claim 14, wherein the decolorizing unit includes:

a first decolorizing unit including a first heat source configured to contact a first surface of the sheet at an upstream position on the conveying path, and a first rotary roller disposed opposite to the first heat source, wherein the sheet is pressed between the first heat source and the first rotary roller by rotation of the first rotary roller and the sheet is conveyed while being heated by the first heat source; and a second decolorizing unit including a second heat source configured to contact a second surface of the sheet at a position on the conveying path downstream from the first erasing unit, and a second rotary roller disposed opposite to the second heat source, wherein the sheet is pressed between the second heat source and the second rotary roller by rotation of the second rotary roller and the sheet is conveyed while being heated by the second heat source, and wherein the decolorization condition setting unit is configured to individually control a temperature of the first heat source and a temperature of the second heat source.

20. The decolorizing device according to claim 19, wherein:

the decolorization condition setting unit is configured to control the temperature of the second heat source to be lower than the temperature of the first heat source, and the color-erasable colorant is a color-erasable toner.

* * * * *